US008597415B2

(12) United States Patent
Noh et al.

(10) Patent No.: US 8,597,415 B2
(45) Date of Patent: Dec. 3, 2013

(54) ELECTRIC PRECIPITATOR AND AIR CLEANER HAVING THE SAME

(75) Inventors: Hyong Soo Noh, Yongin-si (KR); Jun Ho Ji, Namyangiu-si (KR); Kochiyama Yasuhiko, Seongnam-si (KR); So Young Yun, Suwon-si (KR); Dong Woo Woo, Hwaseong-si (KR); Min Kyu Yeo, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 442 days.

(21) Appl. No.: 12/923,572

(22) Filed: Sep. 28, 2010

(65) Prior Publication Data

US 2011/0094383 A1 Apr. 28, 2011

(30) Foreign Application Priority Data

Oct. 28, 2009 (KR) ..... 10-2009-102583

(51) Int. Cl.
*B03C 3/12* (2006.01)

(52) U.S. Cl.
USPC ..... 96/60; 96/63; 96/79; 96/96

(58) Field of Classification Search
USPC ..... 96/60, 63, 77–79, 96, 98; 95/78, 79
See application file for complete search history.

(56) References Cited

U.S. PATENT DOCUMENTS 3,747,299 A * 7/1973 Chiang ..... 95/79
4,119,415 A * 10/1978 Hayashi et al. ..... 96/60
5,037,456 A * 8/1991 Yu ..... 96/76
5,547,496 A * 8/1996 Hara ..... 96/79
5,601,791 A * 2/1997 Plaks et al. ..... 422/169
5,707,428 A * 1/1998 Feldman et al. ..... 96/54
6,251,171 B1 * 6/2001 Marra et al. ..... 96/69
6,506,238 B1 * 1/2003 Endo ..... 96/79
7,261,765 B2 * 8/2007 Katayama ..... 96/19
2008/0307973 A1 * 12/2008 Gale ..... 96/77

FOREIGN PATENT DOCUMENTS

EP 0 556 847 A2 8/1993
JP 62-97650 A * 5/1987
JP 7-265737 10/1995
JP 11-221487 8/1999
WO 2008/138023 A1 11/2008

OTHER PUBLICATIONS

European Search Report dated Feb. 4, 2011 in corresponding European Patent Application 10177758.9.

* cited by examiner

*Primary Examiner* — Richard L Chiesa
(74) *Attorney, Agent, or Firm* — Staas & Halsey LLP

(57) ABSTRACT

Disclosed herein are an electric precipitator, which efficiently charges dust particles without lowering dust collecting efficiency, although a velocity of an air current is not uniform, and an air cleaner having the same. The electric precipitator includes a charger unit including at least two charge cells to charge dust particles contained in air, and a collector unit to collect the dust particles charged by the charger unit. The at least two charge cells include a first cell, through which the dust particles pass at a first velocity, and a second cell, through which the dust particles pass at a second velocity different from the first velocity.

17 Claims, 8 Drawing Sheets

ELECTRIC PRECIPITATOR AND AIR CLEANER HAVING THE SAME

CROSS-REFERENCE TO RELATED APPLICATIONS

This application claims the benefit of Korean Patent Application No. 10-2009-0102583, filed on Oct. 28, 2009 in the Korean Intellectual Property Office, the disclosure of which is incorporated herein by reference.

BACKGROUND

1. Field

Embodiments relate to an electric precipitator, which efficiently charges dust particles even in a region having a high velocity of an air current without lowering dust collecting efficiency, and an air cleaner having the same.

2. Description of the Related Art

In general, electric precipitators are apparatuses, which are mounted in air conditioners, etc., and collect contaminants, such as dust, contained in air so as to purify air.

Among dust collection methods of these electric precipitators, a 2-stage dust collection method in which a charger unit and a collector unit are separately disposed has been widely employed.

In such a 2-stage dust collection method, the charger unit is configured such that a cell formed by a high voltage discharge electrode and counter electrodes is repeatedly installed at the same interval, and the collector unit is configured such that high voltage electrodes and low-voltage electrodes are arranged in parallel to form an electric field.

The high voltage discharge electrodes of the charger unit generally have the shape of a wire, a flat panel, or a needle, and in order to improve discharge characteristics, may have a specific shape. Further, the counter electrodes of the charger unit are installed such that they are separated from the high voltage discharge electrodes by a designated distance and flat surfaces thereof are parallel with an air flow direction.

Such a charger unit serves to charge dust particles, contained in air introduced into the electric precipitator, with positive or negative polarity by corona discharge.

That is, since the counter electrodes are grounded and thus have zero potential, when high voltage of positive polarity or negative polarity is applied to the discharge electrodes, corona discharge occurs between the discharge electrodes and the counter electrodes, dust particles contained in air are charged with positive or negative polarity by the corona discharge, and the charged dust particles move along an air flow to and are collected in the collector unit.

However, when an air flow passing through the electric precipitator is made using an air blower device, dust collecting efficiency of the electric precipitator in some cells having a high velocity of an air current is rapidly lowered. Therefore, the efficiency of the electric precipitator in regions having a high velocity of the air current is lowered, and thus application of the electric precipitator to an air cleaner is hard.

Further, since respective cells are arranged at the same interval in the charger unit of the conventional electric precipitator, dust particles contained in air in cells having a high velocity of the air current may not be sufficiently charged and energy higher than energy required to charge the particles may be input to cells having a low velocity of the air current. Therefore, energy beyond what is required is input, and thus energy efficiency is lowered.

SUMMARY

Therefore, it is one aspect to provide an electric precipitator, which efficiently charges dust particles even in a region having a high velocity of an air current without lowering dust collecting efficiency, and an air cleaner having the same.

It is another aspect to provide an electric precipitator, which improves charging efficiency and dust collecting efficiency even if a velocity of an air current passing through a charger unit is not uniform, and an air cleaner having the same.

Additional aspects will be set forth in part in the description which follows and, in part, will be obvious from the description, or may be learned by practice of the invention.

In accordance with one aspect, an electric precipitator includes a charger unit including at least two charge cells to charge dust particles contained in air, and a collector unit to collect the dust particles charged by the charger unit, wherein the at least two charge cells include a first cell, through which the dust particles pass at a first velocity, and a second cell, through which the dust particles pass at a second velocity different from the first velocity, and the first cell and the second cell respectively charge the dust particles with different charging efficiencies.

If the first velocity is higher than the second velocity, an interval of the first cell may be shorter than an interval of the second cell.

If the first velocity is higher than the second velocity, a thickness of a discharge electrode of the first cell may be greater than a thickness of a discharge electrode of the second cell.

If the first velocity is higher than the second velocity, electrical resistance of a discharge electrode of the first cell may be smaller than electrical resistance of a discharge electrode of the second cell.

The at least two charge cells may include flat panel-shaped counter electrodes, and discharge electrodes, each of which is arranged at a central position of the neighboring counter electrodes in parallel with the counter electrodes.

The discharge electrodes may include discharge wires.

In accordance with a further aspect, an electric precipitator includes a charger unit to charge dust particles contained in air, and a collector unit including at least two dust collection cells to collect the dust particles charged by the charger unit, wherein the at least two charge cells include a first cell, through which the dust particles pass at a first velocity, and a second cell, through which the dust particles pass at a second velocity different from the first velocity.

If the first velocity is higher than the second velocity, an interval of the first cell may be shorter than an interval of the second cell.

The at least two dust collection cells may be formed by alternately stacking high voltage electrodes and low voltage electrodes to collect the dust particles.

In accordance with another aspect, an electric precipitator includes a charger unit including a plurality of charge cells to charge dust particles contained in air, a collector unit including a plurality of dust collection cells to collect the dust particles charged by the charger unit, and an air blower device installed at one side of the plurality of charge cells and the plurality of dust collection cells to form an air current within the plurality of charge cells and the plurality of dust collection cells.

In accordance with another aspect, an electric precipitator includes a charger unit to charge dust particles contained in air, a collector unit to collect the dust particles charged by the charger unit, and an air blower device to form an air current in the charger unit and the collector unit, wherein at least one of the charger unit and the collector unit includes a plurality of first electrodes arranged at different intervals according to velocities of the air current, and a plurality of second electrodes, each of which is arranged at a central position of the neighboring first electrodes in parallel with the plurality of first electrodes.

The plurality of first electrodes and the plurality of second electrodes may respectively form counter electrodes and discharge electrodes to generate corona discharge, thus forming the charger unit, and the discharge electrodes may respectively have different thicknesses.

The plurality of first electrodes and the plurality of second electrodes may respectively form counter electrodes and discharge electrodes to generate corona discharge, thus forming the charger unit, and the discharge electrodes may respectively have different electrical resistances.

The plurality of first electrodes and the plurality of second electrodes may respectively form high voltage electrodes and low voltage electrodes alternately arranged, thus forming the collector unit.

In accordance with another aspect, an air cleaner includes a main body provided with discharge holes formed through the upper surface thereof, a suction grill connected to the main body and provided with suction holes, through which air is inhaled into the main body, an air blower device mounted within the main body to forcibly circulate external air to the inside of the main body, and an electric precipitator arranged at the rear of the suction grill to charge dust particles in the inhaled air using high voltage and then collect the charged dust particles, wherein the electric precipitator includes a charger unit including a plurality of charge cells to charge dust particles contained in air, and a collector unit including a plurality of dust collection cells to collect the dust particles charged by the charger unit, and charging efficiencies or dust collecting efficiencies in at least one of the plurality of charge cells and the plurality of dust collection cells are different according to velocities of the air current.

At least one of the plurality of charge cells and the plurality of dust collection cells may include a plurality of first electrodes arranged at different intervals according to velocities of the air current, and a plurality of second electrodes, each of which is arranged at a central position of the neighboring first electrodes in parallel with the plurality of first electrodes.

The plurality of charging cells may include counter electrodes and discharge electrodes to generate corona discharge, and the discharge electrodes may respectively have different thicknesses.

The plurality of charging cells may include counter electrodes and discharge electrodes to generate corona discharge, and the discharge electrodes may respectively have different electrical resistances.

The plurality of first electrodes and the plurality of second electrodes may respectively form discharge electrodes and counter electrode alternately arranged, thus forming the charger unit to charge the dust particles.

The plurality of first electrodes and the plurality of second electrodes respectively form high voltage electrodes and low voltage electrodes alternately arranged, thus forming the collector unit to collect the dust particles.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
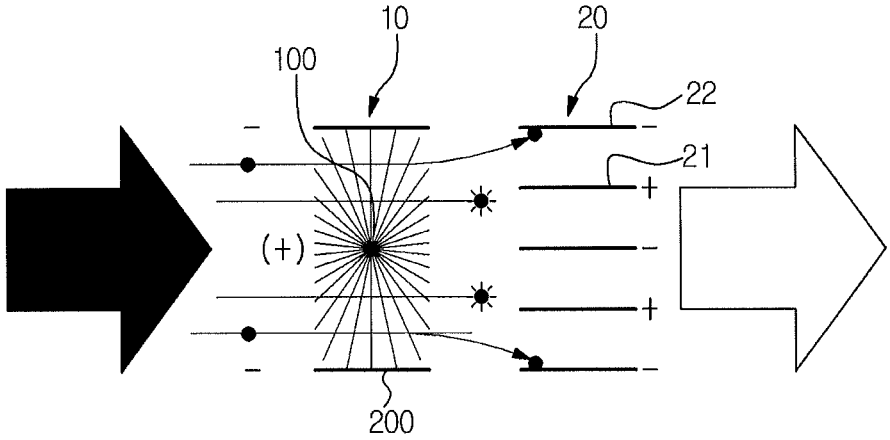
FIG. 1 (PRIOR ART)
FIG. 1 is a view illustrating a fundamental principle of a 2-stage electric precipitator.

Reference will now be made in detail to the embodiments, examples of which are illustrated in the accompanying drawings, wherein like reference numerals refer to like elements throughout.

Figure 2:
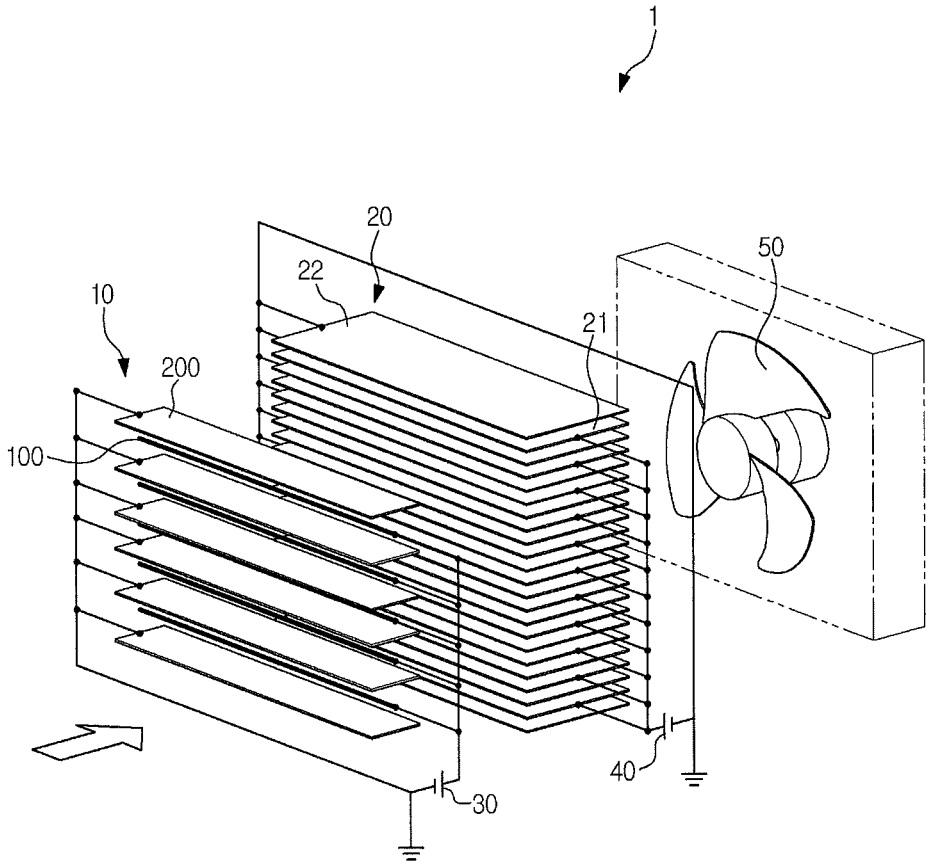
FIG. 2 (PRIOR ART)
FIG. 2 is a perspective view of the 2-stage electric precipitator.

FIG. 1 is a view illustrating a fundamental principle of a 2-stage electric precipitator, and FIG. 2 is a perspective view of the 2-stage electric precipitator.

As shown in FIGS. 1 and 2, an electric precipitator 1 includes a charger unit 10 to charge dust particles contained in air, and a collector unit 20 to collect dust particles charged by the charger unit 10.

The charger unit 10 includes discharge electrodes 100 forming a positive pole by a high voltage power supply 30, and counter electrodes 200 installed above and below the discharge electrodes 100 by a designated height difference and forming a negative pole.

A DC voltage is applied to the discharge electrodes 100, thereby generating corona discharge between the discharge electrodes 100 and the counter electrodes 200.

These discharge electrodes 100 may include thin discharge wires made of tungsten. However, the discharge electrodes 100 may have the shape of a flat panel or a needle, as well as the shape of the wire. Further, the counter electrodes 200 may have the shape of a flat panel.

Therefore, the high voltage power supply 30 applies high voltage to the discharge electrodes 100, current starts to flow due to a high potential difference between the discharge electrodes 100 and the counter electrodes 200 and thus corona discharge is generated, thereby charging dust particles contained in flowing air as shown by arrow.

The collector unit 20 is formed by alternately stacking high voltage electrodes 21 and low voltage electrodes 22 in order to collect the dust particles charged by the charger unit 10.

High voltage of positive polarity is applied to the high voltage electrodes 21 by a high voltage power supply 40, and the low voltage electrodes 22 are grounded to form an electric field.

Accordingly, when dust particles contained in air are charged with positive polarity by corona discharge generated in the charger unit 10, the dust particles charged with positive polarity are collected by the low voltage electrodes 22 having relatively negative polarity of the collector unit 22 due to Coulomb force.

The high voltage power supplies 30 and 40 may have positive polarity or negative polarity, or may supply pulse voltage. Here, reference numeral 50 represents an air blower unit to generate a velocity of the air current in the electric precipitator.

Figure 3:
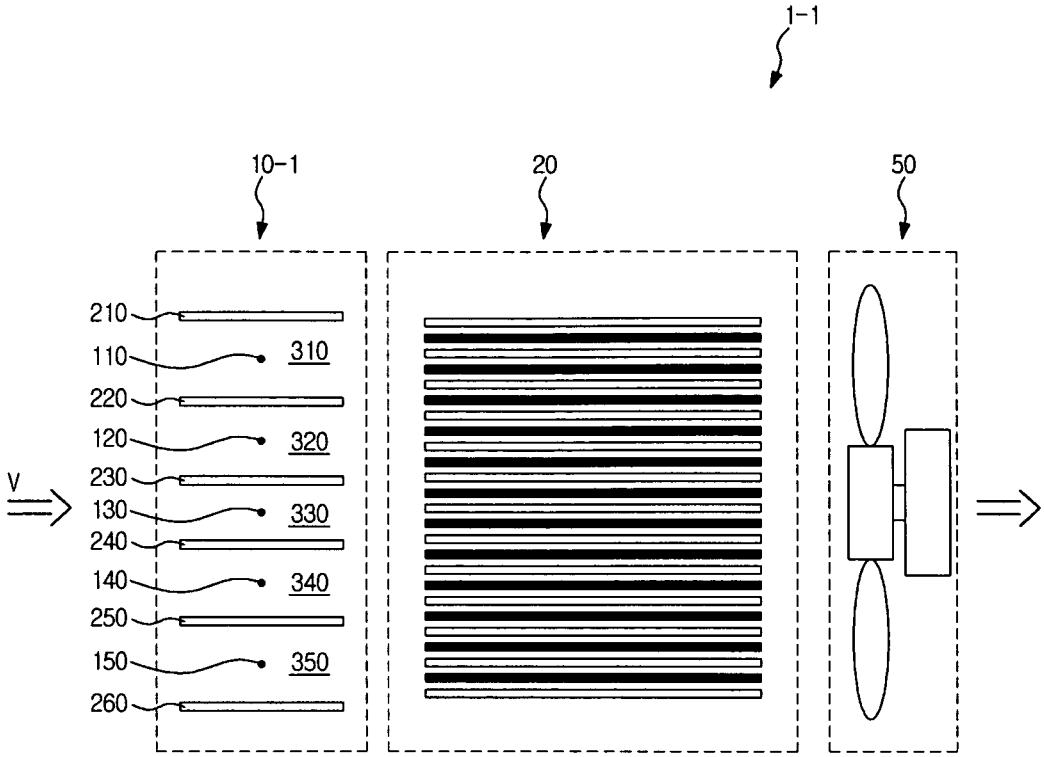
FIG. 3 is a longitudinal-sectional view of an electric precipitator in accordance with one embodiment.
Figure 4:
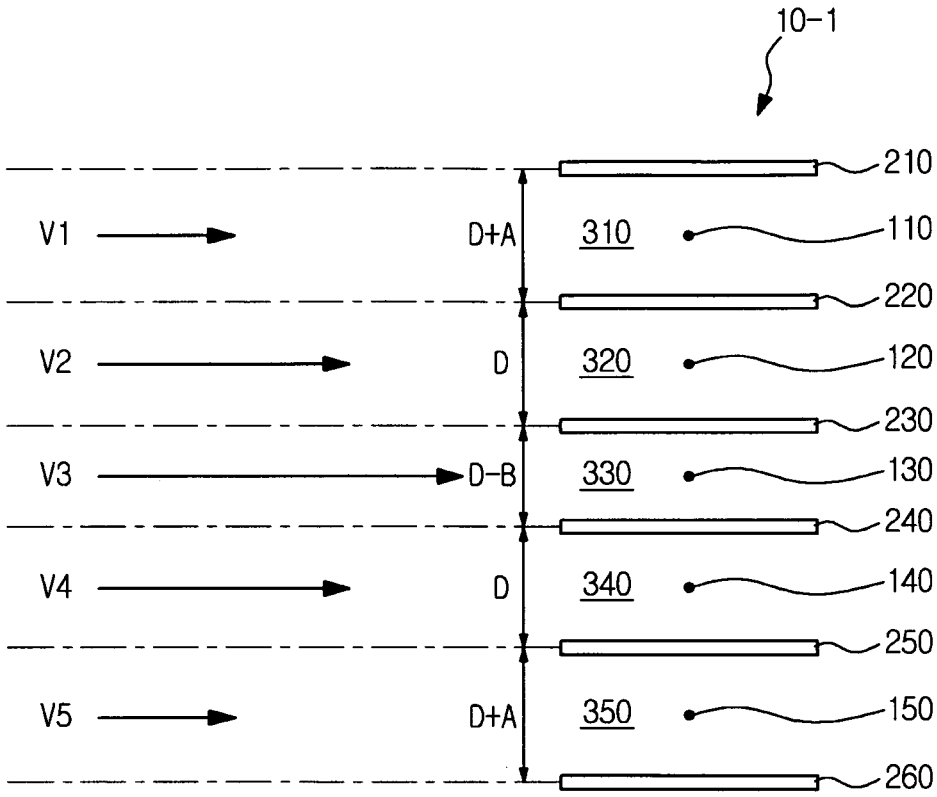
FIG. 4 is an enlarged longitudinal-sectional view of a charger unit of the electric precipitator shown in FIG. 3.

FIG. 3 is a longitudinal-sectional view of an electric precipitator in accordance with one embodiment, and FIG. 4 is an enlarged longitudinal-sectional view of a charger unit of the electric precipitator shown in FIG. 3.

As shown in FIGS. 3 and 4, a charger unit 10-1 of an electric precipitator 1-1 in accordance with one embodiment includes discharge wires 110, 120, 130, 140, and 150, and counter electrodes 210, 220, 230, 240, 250, and 260 to generate corona discharge.

The counter electrodes 210~260 are stacked at different intervals according to velocities V of the air current, and the discharge wires 110~150 are arranged at central positions between the neighboring counter electrodes 210~260.

In such a charger unit 10-1, charge cells 310, 320, 330, 340, and 350, each of which includes one of the discharge wires 110~160 and a pair of the counter electrodes 210~260, are repeatedly formed. Here, the intervals between the counter electrodes 210~260 in the respective charge cells 310~350 are different according to the velocities V of the air current.

For convenience of description, among the charge cells 310~350, the charge cell formed by the first and second counter electrodes 210 and 220 and the first charge wire 110 is referred to as a first charge cell 310, the charge cell formed by the second and third counter electrodes 220 and 230 and the second charge wire 120 is referred to as a second charge cell 320, the charge cell formed by the third and fourth counter electrodes 230 and 240 and the third charge wire 130 is referred to as a third charge cell 330, the charge cell formed by the fourth and fifth counter electrodes 240 and 250 and the fourth charge wire 140 is referred to as a fourth charge cell 340, and the charge cell formed by the fifth and sixth counter electrodes 250 and 260 and the fifth charge wire 150 is referred to as a fifth charge cell 350.

Dust particles contained in air pass through the first charge cell 310 at a first velocity V1, pass through the second charge cell 320 at a second velocity V2, pass through the third charge cell 330 at a third velocity V3, pass through the fourth charge cell 340 at a fourth velocity V4, and pass through the fifth charge cell 350 at a fifth velocity V5. Here, sizes of the respective velocities V1~V5 may satisfy the equation of V3>V2= or ≈V4>V1= or ≈V5, and the second velocity V2 and the fourth velocity V4 are the mean velocity.

In order to satisfy the above velocity distribution in the charger unit 10-1 of the electric precipitator 1-1 in accordance with this embodiment, if the interval between the second counter electrode 220 and the third counter electrode 230 forming the second charge cell 320 and the interval between the fourth counter electrode 240 and the fifth counter electrode 259 forming the fourth charge cell 340 are respectively D, the interval between the first counter electrode 210 and the second counter electrode 220 forming the first charge cell 310 and the interval between the fifth counter electrode 250 and the sixth counter electrode 260 forming the fifth charge cell 350 are respectively D+A, and the interval between the third counter electrode 230 and the fourth counter electrode 240 forming the third charge cell 330 is D−B. Here, A and B may have different values or the same value.

That is, in the charger unit 10-1 of the electric precipitator 1-1 in accordance with this embodiment, the intervals between the neighboring counter electrodes 210~260 have different values, i.e., D, D+A, and D−B, according to the distribution of velocities V of the air current. The interval between the counter electrodes 230 and 240 in the charge cell 330 having a high velocity of the air current is shorter than that in the charge cells 320 and 340 having the mean velocity, and the interval between the counter electrodes 210 and 220 and the interval between the counter electrodes 250 and 260 in the charge cells 310 and 350 having a low velocity of the air current is longer than that in the charge cells 320 and 340 having the mean velocity.

On the assumption that the efficiency of the collector unit 20 of the electric precipitator 1-1 is regular, the higher the particle charging efficiency of the charger unit 10-1 due to corona discharge, the higher is the dust collecting efficiency of the electric precipitator 1-1. This is because the charging efficiency of the charger unit 10-1 is in direct proportion to discharge current of the charger unit 10-1, and is in inverse proportion to the intervals between the neighboring electrodes 210~260 (or, intervals between the neighboring discharge wires 110~150 and counter electrodes 210~260. Therefore, the shorter the intervals between the counter electrodes 210~260 and the longer the discharge current of the charger unit 10-1, the higher is the particle charging efficiency.

Further, when the velocity of the air current passing through the charger unit 10-1 is high, a moving velocity of the dust particles passing through the charger unit 10-1 is increased and the particle charging efficiency is lowered.

Therefore, in the third charge cell 330 having the third velocity V3, i.e., the highest velocity, the interval between the third and fourth counter electrodes 230 and 240 is decreased the most, and the decrease in a charge amount due to the velocity of the air current is compensated for by the increase in corona current.

Further, in the first and fifth charge cells 310 and 350 having the first and fifth velocities V1 and V5, i.e., the lowest velocity, the interval between the first and second counter electrodes 210 and 220 and the interval between the fifth and sixth counter electrodes 250 and 260 are increased the most, and thus although the corona current decreases, sufficient particle charging efficiency is achieved due to the low velocity.

In the same manner, in the second and fourth charge cells 320 and 340 having the second and fourth velocities V2 and V4, i.e., the mean velocity, the interval between the second and third counter electrodes 220 and 230 and the interval between the fourth and fifth counter electrodes 240 and 250 respectively have the mean value D, and thus sufficient particle charging efficiency is obtained.

Therefore, the charging efficiencies of the first charge cell 310, the second charge cell 320, the third charge cell 330, the fourth charge cell 340, and the fifth charge cell 350 may be maintained similarly by adjusting intervals between the neighboring electrodes 210~260 according to the velocities of the air current.

Thus, the electric precipitator 1-1 including the charger unit 10-1 in accordance with this embodiment efficiently charges dust particles even in a region having a high velocity of an air current without lowering dust collecting efficiency, and efficiently divides total energy according to the respective charge cells 310~350 of the charge unit 10-1, thereby improving total energy efficiency.

Figure 5:
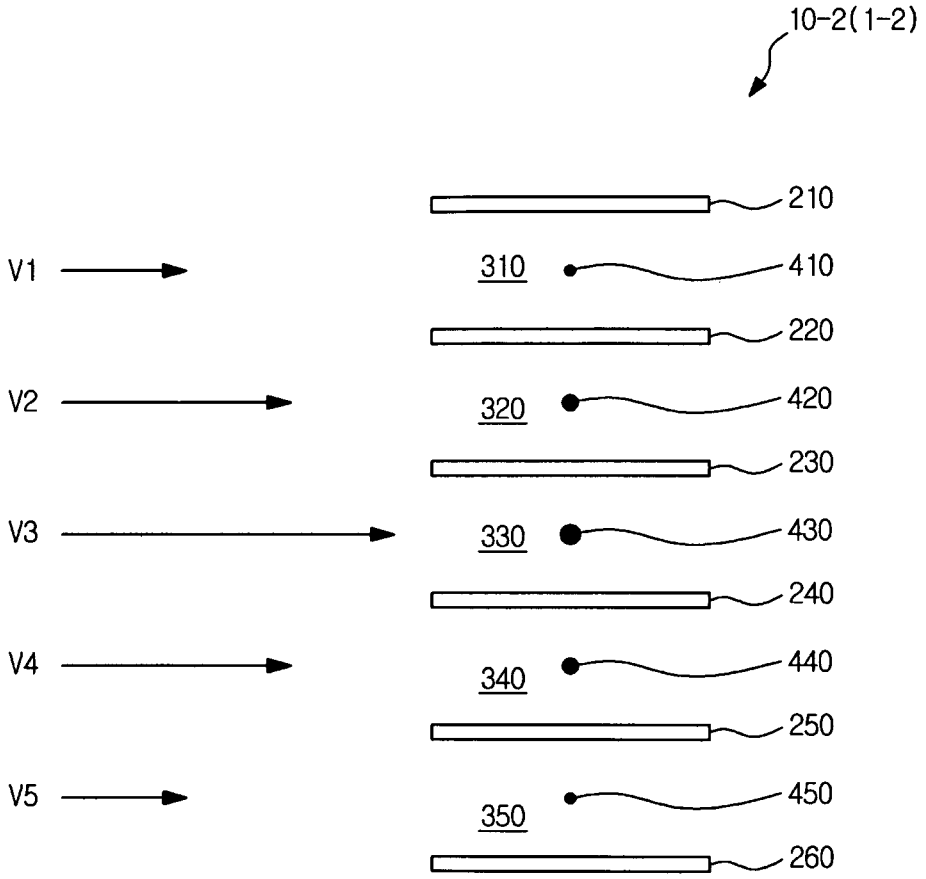
FIG. 5 is a view illustrating a portion of an electric precipitator in accordance with a further embodiment.

Hereinafter, a further embodiment will be described with reference to FIG. 5. Some parts in this embodiment, which are substantially the same as those in the former embodiment shown in FIG. 3, are denoted by the same reference numerals even though they are depicted in different drawings, and a detailed description thereof will thus be omitted. FIG. 5 is a view illustrating a portion of an electric precipitator in accordance with this embodiment.

A charger unit 10-2 of an electric precipitator 1-2 in accordance with this embodiment includes discharge wires 410~450 and counter electrodes 210~260 to generate corona discharge. The counter electrodes 210~260 are stacked at uniform intervals, and the discharge wires 410~450 are arranged at central positions between the neighboring counter electrodes 210~260.

In the electric precipitator 1-2 in accordance with this embodiment, if velocities of air currents passing through respective charge cells 310~350 of the charger unit 10-2 are different, the discharge wires 410~450 of the respective charge cells 310 and 350 of the charger unit 10-2 have different diameters, and thus particle charging efficiencies of the respective charge cells 310 and 350 of the charger unit 10-2 are different.

When the diameters of the discharge wires 410~450 are increased, intervals between the surfaces of the respective discharge wires 410~450 and the surfaces of the counter electrodes 210~260 become narrow, a corona current amount is increased, and particle charging efficiency is increased. On the contrary, when the diameters of the discharge wires 410~450 are decreased, the corona current amount is decreased, and particle charging efficiency is decreased.

Therefore, in the third charge cell 330 having the third velocity V3, i.e., the highest velocity, the diameter of the third discharge wire 430 is increased, and thus decrease in a charge amount due to the velocity of the air current is compensated for by corona current increase.

Further, in the first and fifth charge cells 310 and 350 having the first and fifth velocities V1 and V5, i.e., the lowest velocity, the diameters of the first and fifth discharge wires 410 and 450 are decreased, and thus although corona current decreases, sufficient particle charging efficiency is achieved due to the low velocity.

In the same manner, in the second and fourth charge cells 320 and 340 having the second and fourth velocities V2 and V4, i.e., the mean velocity, the diameters of the second and fourth discharge wires 420 and 440 respectively have the mean value, and thus sufficient particle charging efficiency is obtained.

Therefore, the charging efficiencies of the first charge cell 310, the second charge cell 320, the third charge cell 330, the fourth charge cell 340, and the fifth charge cell 350 may be maintained similarly by varying the diameters of the discharge wires 410~450 according to the velocities of the air current. Thus, the electric precipitator 1-2 in accordance with this embodiment efficiently charges dust particles even in a region having a high velocity of an air current without lowering dust collecting efficiency, and efficiently divides total energy according to the respective charge cells 310~350 of the charge unit 10-2, thereby improving total energy efficiency.

Figure 6:
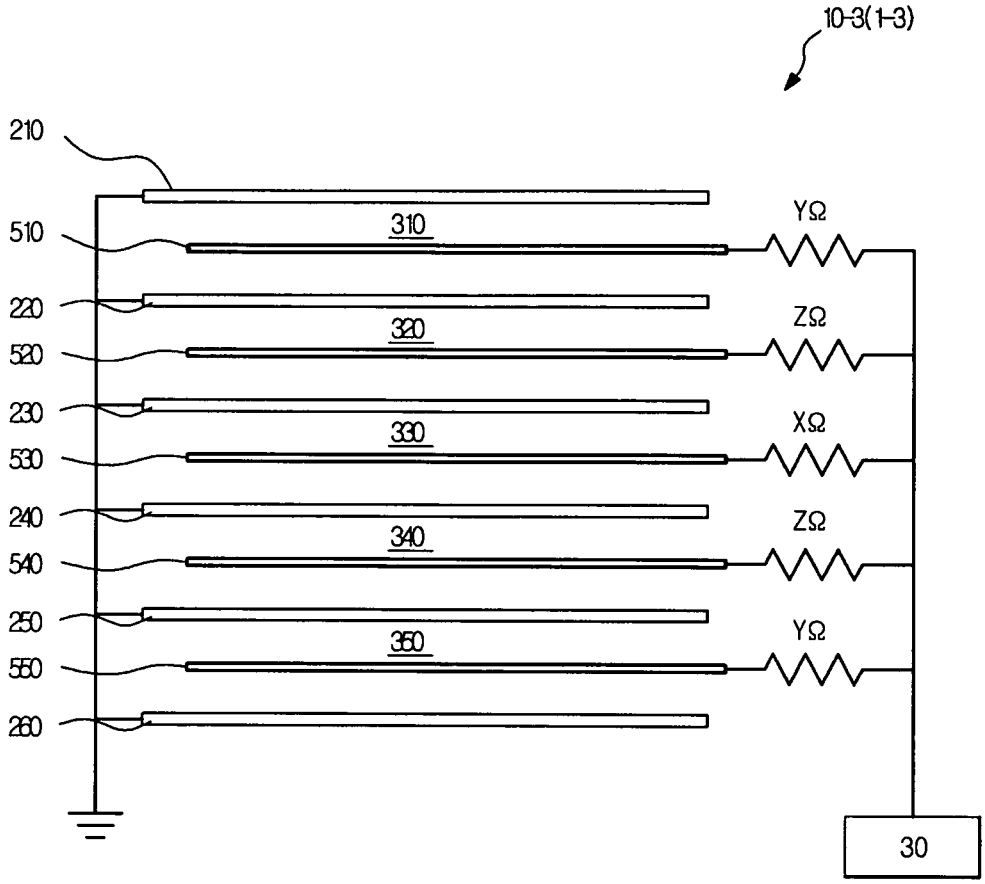
FIG. 6 is a view illustrating a portion of an electric precipitator in accordance with another embodiment.

Hereinafter, another embodiment will be described with reference to FIG. 6. Some parts in this embodiment, which are substantially the same as those in the former embodiment shown in FIG. 3, are denoted by the same reference numerals even though they are depicted in different drawings, and a detailed description thereof will thus be omitted. FIG. 6 is a view illustrating a portion of an electric precipitator in accordance with this embodiment.

A charger unit 10-3 of an electric precipitator 1-3 in accordance with this embodiment includes discharge wires 510~550 and counter electrodes 210~260 to generate corona discharge. The counter electrodes 210~260 are stacked at uniform intervals, and the discharge wires 510~550 are arranged at central positions between the neighboring counter electrodes 210~260.

In the electric precipitator 1-3 in accordance with this embodiment, if velocities of air currents passing through respective charge cells 310~350 of the charger unit 10-3 are different, the discharge wires 510~550 of the respective charge cells 310 and 350 of the charger unit 10-3 have different electrical resistances, and thus particle charging efficiencies of the respective charge cells 310 and 350 of the charger unit 10-2 are different.

If the discharge wires 510~550 of the respective charge cells 310~350 of the charger unit 10-3 are installed in parallel and the electrical resistances of the respective charge cells 310~350 are equal or substantially equal, when a designated voltage is applied to the charger unit 10-3 by the high voltage power supply 30, voltage and current applied to the respective charge cells 310~350 are equal or substantially equal. However, if the discharge wires 510~550 of the respective charge cells 310 and 350 of the charger unit 10-3 have different electrical resistances, voltages applied to the respective charge cells 310~350 are equal or substantially equal but currents applied to the respective charge cells 310~350 are different according to the electrical resistances. By varying corona current amounts of the respective charge cells 310~350 of the charger unit 10-3 in this way, the electric precipitator 1-3 in accordance with this embodiment obtains the same effects as the electric precipitator 1-1 in accordance with the embodiment shown in FIG. 3 and the electric precipitator 1-2 in accordance with the embodiment shown in FIG. 5.

That is, if the velocity of the air current in the third charge cell 330 is the highest, the third discharge wire 530 has the smallest electrical resistance X[Ω], and thus decrease in a charge amount due to the velocity of the air current is compensated for by corona current increase.

Further, if the velocities of the air current in the first and fifth charge cells 310 and 350 are the lowest, the first and fifth discharge wires 510 and 550 have the greatest electrical resistance Y[Ω], and thus although corona current decreases, sufficient particle charging efficiency is achieved due to the low velocity.

In the same manner, if the velocities of the air current in the second and fourth charge cells 320 and 340 are the mean, the second and fourth discharge wires 520 and 540 have the mean electrical resistance Z[Ω], and thus sufficient particle charging efficiency is obtained.

Therefore, the charging efficiencies of the first charge cell 310, the second charge cell 320, the third charge cell 330, the fourth charge cell 340, and the fifth charge cell 350 may be maintained similarly by varying the electrical resistances of the discharge wires 510~550 according to the velocities of the air current. Thus, the electric precipitator 1-3 in accordance with this embodiment efficiently charges dust particles even in a region having a high velocity of an air current without lowering dust collecting efficiency, and efficiently divides total energy according to the respective charge cells 310~350 of the charge unit 10-3, thereby improving total energy efficiency.

Figure 7:
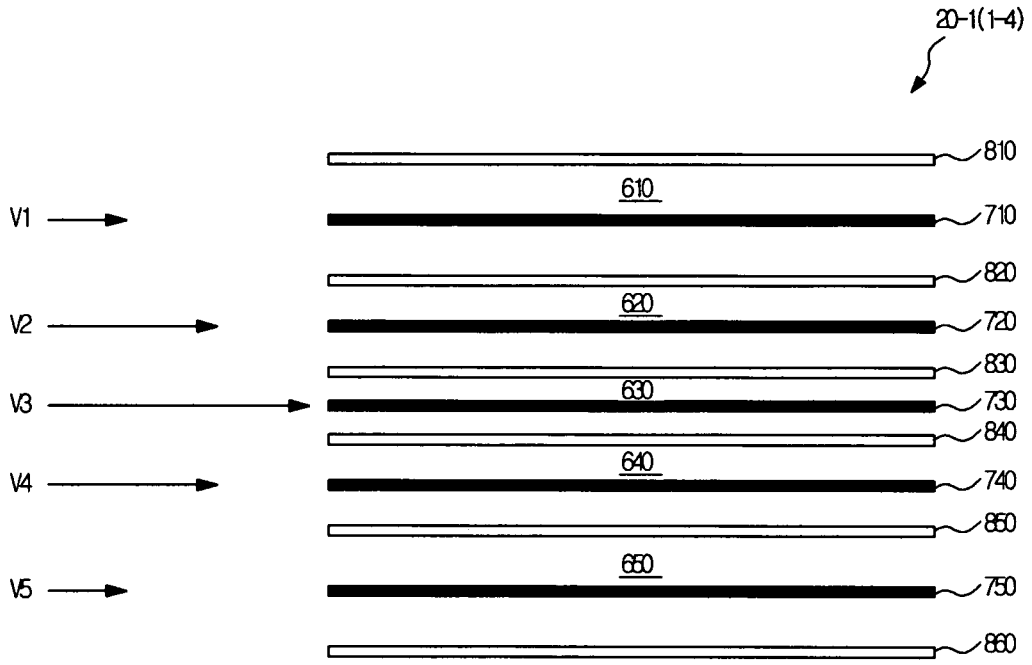
FIG. 7 is a view illustrating a portion of an electric precipitator in accordance with yet another embodiment.

Hereinafter, yet another embodiment will be described with reference to FIG. 7. Some parts in this embodiment, which are substantially the same as those in the former embodiment shown in FIG. 3, are denoted by the same reference numerals even though they are depicted in different drawings, and a detailed description thereof will thus be omitted. FIG. 7 is a view illustrating a portion of an electric precipitator in accordance with this embodiment.

A collector unit 20-1 of an electric precipitator 1-4 in accordance with this embodiment includes high voltage electrodes 710~750 and low voltage electrodes 810~860 to collect dust particles charged by a collector unit (not shown).

The low voltage electrodes 810~860 are stacked at different intervals according to velocities V1, V2, V3, V4, and V5 of the air current, and the high voltage electrodes 710~760 are arranged at central positions between the neighboring low voltage electrodes 810~860.

In such a collector unit 20-1, dust collection cells 610~650, each of which consists of one of the high voltage electrodes 710~760 and a pair of the low voltage electrodes 810~860, are repeatedly formed. Here, the intervals between the neighboring low voltage electrodes 810~860 in the respective dust collection cells 310~350 may be different according to velocities V1, V2, V3, V4, and V5 of the air current.

That is, in the third dust collection cell 630 having the third velocity V3 of the air current, i.e., the highest velocity, the interval between the third and fourth low voltage electrodes 830 and 840 is decreased the most, and thus the decrease in a charge amount due to the velocity of the air current is compensated for by Coulomb force increase.

Further, in the first and fifth dust collection cells 610 and 650 having the first and fifth velocities V1 and V5 of the air current, i.e., the lowest velocity, the interval between the first and second low voltage electrodes 810 and 820 and the interval between the fifth and sixth low voltage electrodes 850 and 860 are longest wide, and thus although Coulomb force decreases, sufficient particle charging efficiency is achieved due to the low velocity.

In the same manner, in the second and fourth dust collection cells 620 and 640 having the second and fourth velocities V2 and V4 of the air current, i.e., the mean velocity, the interval between the second and third low voltage electrodes 820 and 830 and the interval between the fourth and fifth low voltage electrodes 840 and 850 respectively have the mean value, and thus sufficient particle charging efficiency is obtained.

Therefore, the dust collecting efficiencies of the first dust collection cell 610, the second dust collection cell 620, the third dust collection cell 630, the fourth dust collection cell 640, and the fifth dust collection cell 650 may be maintained similarly by varying the intervals between the neighboring low voltage electrodes 810~860 according to the velocities of the air current.

Thus, the electric precipitator 1-4 in accordance with this embodiment efficiently collects dust particles even in a region having a high velocity of an air current without lowering dust collecting efficiency, and efficiently divides total energy according to the respective dust collection cells 610~650 of the collector unit 20-1, thereby improving total energy efficiency.

The above-described respective embodiments may be separately executed, or combinations of at least some of the respective embodiments may be executed.

Figure 8:
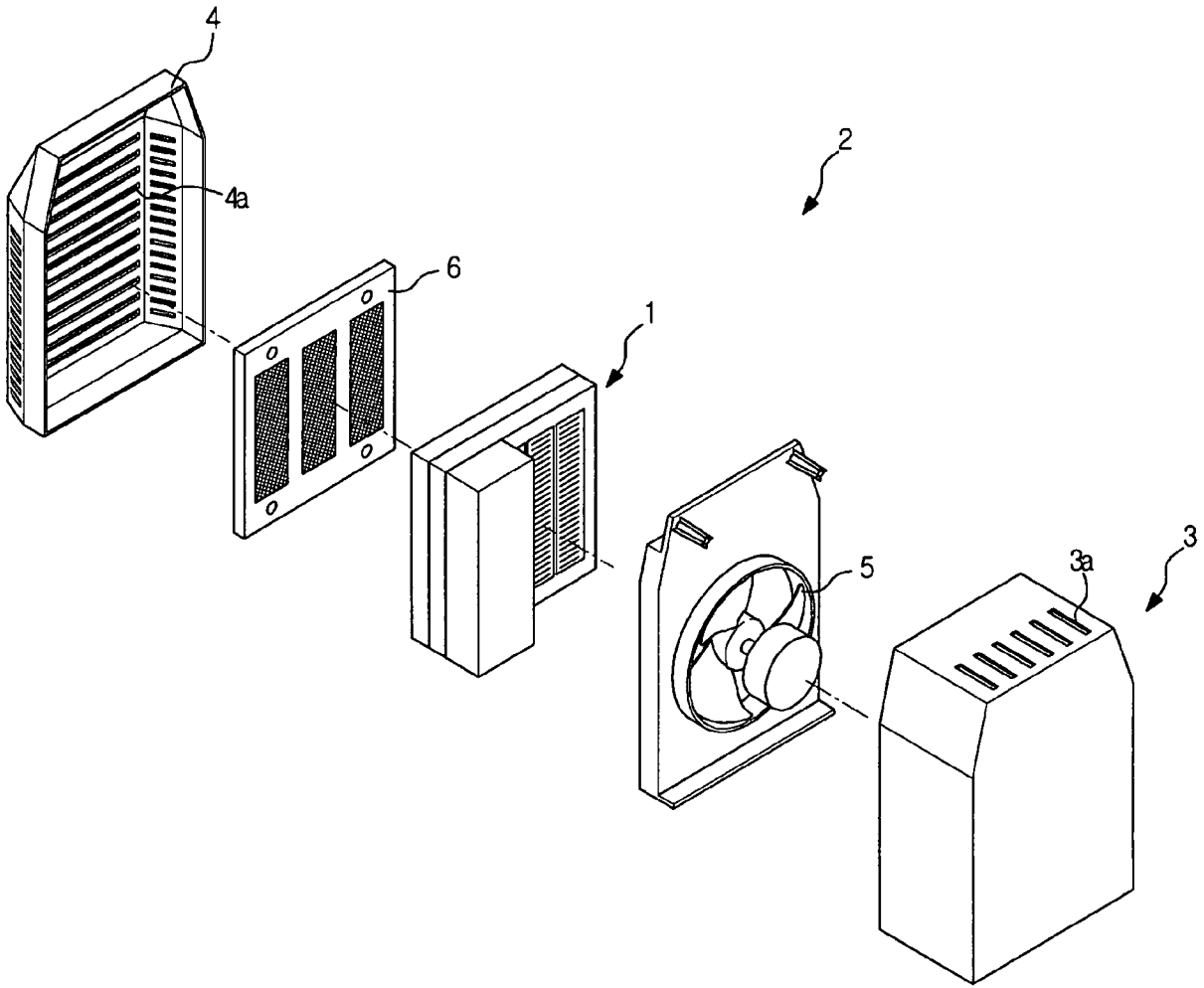
FIG. 8 is an exploded perspective view of an air cleaner in accordance with one embodiment.

Hereinafter, an air cleaner, to which an electric precipitator in accordance with one embodiment is applied, will be described. FIG. 8 illustrates the air cleaner in accordance with this embodiment.

As shown in FIG. 8, an air cleaner 2 in accordance with this embodiment includes a main body 3 provided with discharge holes 3*a*, through which air is discharged to the outside of the main body 3, formed through the upper surface thereof, a suction grill 4 connected to the main body 3 and provided with suction holes, through which air is inhaled into the main body 3, an air blower device 5 mounted within the main body 3 to forcibly circulate external air to the inside of the main body 3, an air filter 6 arranged on the rear surface of the suction grill 4 to filter out dust particles having a high volume from inhaled air, and an electric precipitator 1 arranged at the rear of the air filter 6 to charge dust particles contained in the inhaled air using high voltage and then collect the charged dust particles.

The air cleaner 2 inhales external air through operation of the air blower device 5, converts the inhaled air into clean air through the air filter 6 and the electric precipitator 1, and then discharges the clean air to the outside of the main body 3.

That is, when power is applied to the air blower device 5 and the electric precipitator 1 installed in the main body 3, the air blower device 5 is driven such that external air is inhaled to the inside of the air cleaner 2. After the external air is inhaled into the main body 3 through the suction holes 4*a* formed through the suction grill 4, relatively large dust particles are filtered out by the air filter 6, and then fine dust particles are filtered out by the electric precipitator 1.

Here, when power is applied to the electric precipitator 1, the electric precipitator 1 ionizes fine dust particles passing therethrough due to corona discharge, and then collects charged dust particles, thereby removing the fine dust particles contained in air.

At this time, when the air blower device 5 is driven to inhale external air, the external air is inhaled at a relatively high velocity in some portions and is inhaled at a relatively low velocity in other portions. Such a velocity difference causes a charger unit (not shown) of the electric precipitator 1 to have different charging efficiencies (or causes a collector unit (not shown) to have different dust collecting efficiencies), thereby allowing the electric precipitator 1 to effectively divisionally use total energy.

As is apparent from the above description, in an electric precipitator and an air cleaner in accordance with one embodiment, charging efficiencies or dust collecting efficiencies in a charge unit or a collector unit are varied according to characteristics of an air current passing through the electric precipitator, thereby efficiently charging dust particles even in a region having a high velocity of the air current and allowing total energy to be efficiently divisionally used according to respective cells.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An electric precipitator comprising:

a charger unit including at least two charge cells to charge dust particles contained in air; and a collector unit to collect the dust particles charged by the charger unit, wherein:

the at least two charge cells include a first cell, through which the dust particles pass at a first velocity, and a second cell, through which the dust particles pass at a second velocity different from the first velocity; and the first cell and the second cell respectively charge the dust particles compensating the difference of a charge amount due to the difference of the first velocity and the second velocity.

2. The electric precipitator according to claim 1, wherein, if the first velocity is higher than the second velocity, an interval of the first cell is shorter than an interval of the second cell.

3. The electric precipitator according to claim 1, wherein, if the first velocity is higher than the second velocity, a thickness of a discharge electrode of the first cell is greater than a thickness of a discharge electrode of the second cell.

4. The electric precipitator according to claim 1, wherein, if the first velocity is higher than the second velocity, electrical resistance of a discharge electrode of the first cell is smaller than electrical resistance of a discharge electrode of the second cell.

5. The electric precipitator according to claim 1, wherein the at least two charge cells include flat panel-shaped counter electrodes, and discharge electrodes, each of which is arranged at a central position of the neighboring counter electrodes in parallel with the counter electrodes.

6. The electric precipitator according to claim 5, wherein the discharge electrodes include discharge wires.

7. An electric precipitator comprising:

a charger unit including a plurality of charge cells to charge dust particles contained in air;

a collector unit including a plurality of dust collection cells to collect the dust particles charged by the charger unit; and an air blower device installed at one side of the plurality of charge cells and the plurality of dust collection cells to form an air current within the plurality of charge cells and the plurality of dust collection cells, wherein at least one of the plurality of charge cells and the plurality of dust collection cells charge or collect a dust compensating the difference of a charge or a collection dust amount due to the velocity difference of the air current.

8. An electric precipitator comprising:

a charger unit to charge dust particles contained in air;

a collector unit to collect the dust particles charged by the charger unit; and an air blower device to form an air current in the charger unit and the collector unit, wherein at least one of the charger unit and the collector unit includes a plurality of first electrodes arranged at different intervals according to velocities of the air current, and a plurality of second electrodes, each of which is arranged at a central position of the neighboring first electrodes in parallel with the plurality of first electrodes.

9. The electric precipitator according to claim 8, wherein:

the plurality of first electrodes and the plurality of second electrodes respectively form counter electrodes and discharge electrodes to generate corona discharge, thus forming the charger unit; and the discharge electrodes respectively have different thicknesses.

10. The electric precipitator according to claim 8, wherein:

the plurality of first electrodes and the plurality of second electrodes respectively form counter electrodes and discharge electrodes to generate corona discharge, thus forming the charger unit; and the discharge electrodes respectively have different electrical resistances.

11. The electric precipitator according to claim 8, wherein the plurality of first electrodes and the plurality of second electrodes respectively form high voltage electrodes and low voltage electrodes alternately arranged, thus forming the collector unit.

12. An air cleaner comprising:

a main body provided with discharge holes formed through the upper surface thereof;

a suction grill connected to the main body and provided with suction holes, through which air is inhaled into the main body;

an air blower device mounted within the main body to forcibly circulate external air to the inside of the main body; and an electric precipitator arranged at the rear of the suction grill to charge dust particles in the inhaled air using high voltage and then collect the charged dust particles, wherein:

the electric precipitator includes a charger unit including a plurality of charge cells to charge dust particles contained in air, and a collector unit including a plurality of dust collection cells to collect the dust particles charged by the charger unit; and at least one of the plurality of charge cells and the plurality of dust collection cells charge or collect a dust compensating the difference of a charge or a collection dust amount due to the velocity difference of the air current.

13. The air cleaner according to claim 12, wherein at least one of the plurality of charge cells and the plurality of dust collection cells includes a plurality of first electrodes arranged at different intervals according to velocities of the air current, and a plurality of second electrodes, each of which is arranged at a central position of the neighboring first electrodes in parallel with the plurality of first electrodes.

14. The air cleaner according to claim 12, wherein:

the plurality of charging cells includes counter electrodes and discharge electrodes to generate corona discharge; and the discharge electrodes respectively have different thicknesses.

15. The air cleaner according to claim 12, wherein:

the plurality of charging cells includes counter electrodes and discharge electrodes to generate corona discharge; and the discharge electrodes respectively have different electrical resistances.

16. The air cleaner according to claim 13, wherein the plurality of first electrodes and the plurality of second electrodes respectively form discharge electrodes and counter electrodes alternately arranged, thus forming the charger unit to charge the dust particles.

17. The air cleaner according to claim 13, wherein the plurality of first electrodes and the plurality of second electrodes respectively form high voltage electrodes and low voltage electrodes alternately arranged, thus forming the collector unit to collect the dust particles.

* * * * *

UNITED STATES PATENT AND TRADEMARK OFFICE

CERTIFICATE OF CORRECTION

PATENT NO. : 8,597,415 B2
APPLICATION NO. : 12/923572
DATED : December 3, 2013
INVENTOR(S) : Hyong Soo Noh et al.

It is certified that error appears in the above-identified patent and that said Letters Patent is hereby corrected as shown below:

On the Title page, Column 1, item 75 (Inventors), Line 2, Delete "Namyangiu-si" and insert -- Namyangju-si --, therefor.

Signed and Sealed this
First Day of April, 2014

Michelle K. Lee

Michelle K. Lee
*Deputy Director of the United States Patent and Trademark Office*